US006814465B2

(12) United States Patent
Försythe

(10) Patent No.: US 6,814,465 B2
(45) Date of Patent: Nov. 9, 2004

(54) SECURITY FLASHLIGHT AND METHOD

(76) Inventor: John D. Försythe, 94 Carlotta Ave., Hyannis, MA (US) 02601

( * ) Notice: Subject to any disclaimer, the term of this patent is extended or adjusted under 35 U.S.C. 154(b) by 0 days.

(21) Appl. No.: 10/246,917

(22) Filed: Sep. 19, 2002

(65) Prior Publication Data

US 2003/0016533 A1 Jan. 23, 2003

Related U.S. Application Data

(63) Continuation-in-part of application No. 09/641,481, filed on Aug. 18, 2000, now abandoned.
(60) Provisional application No. 60/191,629, filed on Mar. 23, 2000.

(51) Int. Cl.[7] ..... F21L 4/04
(52) U.S. Cl. ..... 362/205; 362/109
(58) Field of Search ..... 362/109, 189, 362/116, 207, 205

(56) References Cited

U.S. PATENT DOCUMENTS

| | | | | | |
|---|---|---|---|---|---|
| 2,235,714 | A | * | 3/1941 | Lennan | 362/158 |
| 2,729,740 | A | * | 1/1956 | Davis | 362/158 |
| 3,079,492 | A | * | 2/1963 | Bolinger | 362/189 |
| 3,806,724 | A | * | 4/1974 | Tanner et al. | 362/189 |
| 3,890,498 | A | * | 6/1975 | Toth, Sr. | 362/205 |
| 4,242,724 | A | | 12/1980 | Stone | 362/158 |
| 4,399,495 | A | | 8/1983 | Leopoldi et al. | 362/189 |
| 4,408,263 | A | * | 10/1983 | Sternlicht | 362/189 |
| 4,415,954 | A | * | 11/1983 | Schaefer | 362/202 |
| 4,433,365 | A | | 2/1984 | Rousseau | 362/189 |
| 4,559,588 | A | * | 12/1985 | Engelson et al. | 362/196 |
| 4,644,451 | A | * | 2/1987 | Chabria | 362/189 |
| 4,731,712 | A | | 3/1988 | Amthor | 362/189 |
| 4,768,138 | A | | 8/1988 | Leopoldi et al. | 362/189 |
| 5,171,086 | A | * | 12/1992 | Baloochi | 362/188 |
| 5,364,097 | A | * | 11/1994 | Lyon | 463/47.4 |
| 5,410,939 | A | * | 5/1995 | Matamoros et al. | 84/458 |
| 5,434,761 | A | | 7/1995 | Lesnick et al. | 362/189 |
| 5,601,359 | A | * | 2/1997 | Sharrah et al. | 362/204 |
| 5,660,458 | A | * | 8/1997 | Chabria | 362/189 |
| 5,678,921 | A | | 10/1997 | Kish et al. | 362/205 |
| 5,735,594 | A | * | 4/1998 | Own | 362/202 |
| 5,895,115 | A | * | 4/1999 | Parker et al. | 362/511 |
| 6,039,456 | A | | 3/2000 | Chabria | 362/189 |
| 6,062,700 | A | | 5/2000 | Price | 362/103 |
| 6,062,702 | A | | 5/2000 | Krietzman | 362/158 |
| 6,158,875 | A | * | 12/2000 | Olivit et al. | 362/189 |
| 6,184,794 | B1 | * | 2/2001 | Tucholski | 340/636.14 |

* cited by examiner

*Primary Examiner*—John Anthony Ward
(74) *Attorney, Agent, or Firm*—Leslie Meyer-Leon, Esq.; IP Legal Strategies Group P.C.

(57) ABSTRACT

A security flashlight for emergency light situations, with a handgrip area, which area incorporates one or more radial pressure switches, which are activated between on and off positions by designated hand grip pressure, without longitudinal movement of the user's hand.

11 Claims, 1 Drawing Sheet

SECURITY FLASHLIGHT AND METHOD

REFERENCE TO PRIOR APPLICATIONS

This application is a continuation-in-part of U.S. patent application Ser. No. 09/641,481, filed Aug. 18, 2000 abandoned, which claims priority from U.S. Ser. No. 60/191,629, filed Mar. 23, 2000, each hereby incorporated by reference.

BACKGROUND OF THE INVENTION

Security flashlights are typically shock-resistant, heavy, multibattery-containing and operated, waterproof flashlights with a light source and lens at one end of an elongated casing or battery container. Batteries are inserted and removed from the one or other end. The light source is operated by a single on-off pressure or slidable flashlight switch, generally located and positioned toward the light source end of the flashlight.

In law enforcement, security, and military use, time is critical in the use of a flashlight to illuminate areas in generally low light or dark situations, in combat, and in emergency situations.

Squeeze or pressure-operated flashlights are described in U.S. Pat. No. 4,731,712, issued Mar. 15, 1988, and U.S. Pat. No. 6,039,456, issued Mar. 21, 2000, which show small flashlights with flexible housings and wherein the flashlight is generally activated by light finger-thumb pressure. U.S. Pat. No. 5,434,761, issued Jul. 18, 1995, is also directed to a squeezable flashlight, but of the novelty-type, where manual squeezing of a selected region of a deformable novelty character body between thumb and fingers activates an electrical circuit to energize the novelty light. Flashlights that have flexible housings, or that are activated by light finger-thumb pressure, are not suitable equipment for use by security personnel.

It is desirable to provide for a new and improved flashlight, particularly useful as a security flashlight, and where prompt illumination is important.

SUMMARY OF THE INVENTION

The present invention relates to a flashlight and method adapted and constructed to provide light promptly in stressful, critical, and/or life-threatening emergency situations for security personnel, such as police officers, security officers, military personnel and firefighters. The flashlight of the invention is a security flashlight designed for use by police officers, security officers, military personnel and firefighters in performance of their jobs. It is used as a regular or standard part of the equipment of security personnel. It is made of a material that is durable, long lasting, heavy duty, and designed for years of service. Such materials are known to those of skill in the art of security equipment, e.g., metal, e.g., aircraft aluminum or a plastic material, e.g., such as a, polycarbonate composite.

Preferably, the flashlight of the invention is from six to twelve inches (6–12") long, or can be longer.

In one aspect, the flashlight of the invention includes an elongated casing, or housing, having a one end and other end, a light source at the one end, and means at the one or other end to insert and remove one or more batteries within the casing to supply power to the light source. A handgrip area surrounds, and is peripheral to, a region of the underlying elongated hard casing.

The elongated casing is a hard casing. By "hard casing" is meant that the hand grip pressure exerted by the user, on the handgrip area or coating to activate the light source, does not transfer through, distort, or deform the casing itself. In another embodiment, those skilled in the art of security equipment are aware that at times it may be necessary for security personnel to use a security flashlight to hit or strike a target or an object. Thus, it is preferred that the casing of the flashlight be resistant to breaks, cracks, or dents when used to forcefully strike an object.

The flashlight of the invention features an improved on-off light switch to activate the light source. The improvement comprises one or a plurality of spaced-apart, hand-operated, pressure-activated, on-off light switch means. The switch or switch means is generally peripherally arranged about the casing in the handgrip area as a band switch, or a plurality of spaced-apart switches forming a band, and the switch means disposed generally in a handgrip area, intermediate the one and the other end of the casing, to provide for rapid activation and deactivation of the on-off switch means by gripping hand pressure of the fingers and palm of the user against the radial pressure switch, in emergency situations.

The flashlight switch means comprises one or more user hand pressure-activated, light switch band or bands, which extend continuously about the periphery of the casing. The flashlight light switch comprises one or a plurality of generally elongated, spaced-apart, light switches, any one of which light switches, e.g., electrically connected in series, activate the power source.

In one embodiment, the flashlight switch means is designed, arranged, and constructed to respond only to hand pressure of the user that exceeds a particular or selected pressure in comparison to the normal user hand pressure by deliberate squeezing, to hold and direct the light source that has to cast the light, beam, illuminate for any distance from 1 to 21 feet (7 yards a critical zone) or 50 feet or 100 feet or more at any time. In emergency use, the user's tightening or squeezing hand pressure can immediately activate and deactivate the switch or switches and illuminate or cease to illuminate the area, without the need for the user to shift the user's hand or to use a thumb or finger. The advantage of being able to activate the light switch without shifting of the user's hand, and without using a thumb or finger, is critical in stressful emergency situations. At such times, when time intervals of, e.g., fractions of a second, may be critical and may not permit the more time consuming act of reaching for the forward, on-off light switches conventional on traditional security flashlights, the hand grip mechanism of the flashlight of the invention confers a substantial, even lifesaving, advantage.

If desired, the light switch means may incorporate a variable resistance, so that turning of the band switch or the multiple switches will vary the intensity of the light source, without shifting or removal of the user's hand from the handgrip area. The on-off or variable light switch should be generally positioned ergonomically in the middle or hand balance area of the flashlight and cover all, or substantially all, of the circumference, which will activate or deactivate without moving hand or the need to take eyes off target area (subject or danger) to coordinate looking for and operating a button or slide switch with the thumb or fingers.

In one embodiment, the entire handgrip area, or handgrip surface, of the flashlight is a switch itself, and the switch is activated by squeezing hand pressure anywhere on the grip area. In another embodiment, the switch means may comprise a plurality of separate, spaced-apart, elongated, longitudinal, extended peripheral switch pads on the exterior surface of the casing, e.g., 7 to 13 inches, any one of which, on hand squeezing, activates the light source. In a further embodiment, the switch means may comprise a single band or a plurality of spaced-apart, radial switches about the handgrip area, where the activation of the light source is accomplished by activated, full hand pressure on any one, or if desired, a selected plurality of the band switches.

The radial, pressure-activated switch or switches are designed to activate only when subjected to substantial hand or gripping pressure. The gripping pressure must exceed a normal or typical holding and directing pressure. Preferably, activation requires a gripping pressure of greater than 5 to 10 pounds per square inch. The switch may comprise metal, spaced-apart connectors separated by electrical insulators, and typically, tension or spring-biased to an outward off position. For example, the switch may comprise a continuous, inner metal band and an opposite, radial, spaced-apart, outer metal band electrically insulated and tension-biased away from the inner band, whereby radial, gripping, hand pressure permits electrical contact between the inner and outer bands to activate the light source.

Those skilled in. the art will appreciate that, to solve the security problems of the invention, the user must have total control over the decision to activate the light switch, and must also have control over deactivation of the light switch. For example, in critical or emergency situations such as those posed by crime or combat areas, it is essential that the security flashlight be prevented from illuminating at inappropriate times, such as when the cover of darkness is essential to the safety of the user, or to the success of a security mission. For that reason it is a critical feature of the invention that full hand pressure of the fingers, thumb, and palm must be applied to activate the switch to place the metal bands in electrical contact, to provide battery power to the light source. Gripping pressure applied by merely the fingertips or thumb would not be sufficient to activate the switch pads.

The light switch or switches may be positioned as light switches on the exterior surface of the handgrip area or be nonvisible and enclosed within a shock-absorbing, waterproof cover or coating on the casing. Typically, the handgrip area includes a knuckled or rough surface to provide an antislip area.

The security flashlight is activated by merely hand or squeeze, generally radial, pressure against the light switch means and avoids the user fumbling with the thumb or finger to find the on-off switch or removal of the user's eyes from the target or area to be illuminated. The movement of the switch to the intermediate, visual, handgrip area of the flashlight also contributes to maintaining the balance of the flashlight.

The invention will be described for the purpose of illustration only in connection with certain illustrated embodiments; however, it is recognized that various changes, modifications, additions, and improvements may be made in the illustrative embodiments without departing from the spirit or scope of the invention.

DESCRIPTION OF THE EMBODIMENTS

Figure 1:
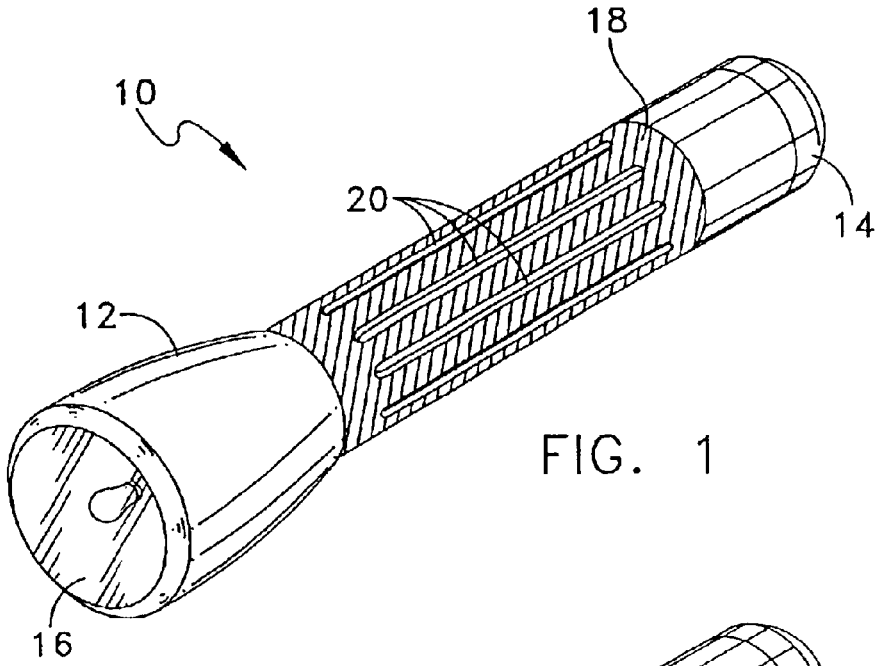
FIG. 1 is a perspective view of one embodiment of the security flashlight of the invention.

FIG. 1 shows a flashlight 10 with a shock-absorbing, waterproof casing 12 or battery compartment with aligned batteries (not shown) and with a threaded end cap 14 to be opened and closed at will for access to the battery compartment, and to replace batteries, light bulb, and reflector lens 16. The flashlight 10 includes a knuckled, antislip, handgrip area 18 and a plurality of uniformly spaced-apart, elongated, pressure switch pads 20 about the circumference of the handgrip area 18, which, for example, may extend from about 6 to 14 inches.

In use, activation of one or more of the switch pads 20, when hand-gripped by a user, activates the light source 16. The light source 16, e.g., a light bulb, e.g., a high candle power light bulb, such as that of a halogen or krypton bulb, should be of a substantial size, the size being sufficient to cast a beam of light far enough to illuminate a target at a distance of at least, e.g., 9 feet or even 25 or 100 feet, or such distances expected by those skilled in the art of law enforcement and security. The switch pads 20 must be squeezed or pressed by the user's radial total hand or fingers and palm pressure in an excess over normal holding pressure, in order to activate or place the switch pads 20 in an "on" position.

The security flashlight 10 permits a user, such as a military personnel, firefighter, security agent, or police officer, to activate the flashlight promptly in emergency situations, without the need to feel or look around for an on-off, sliding or pressure switch in another location.

Figure 2:
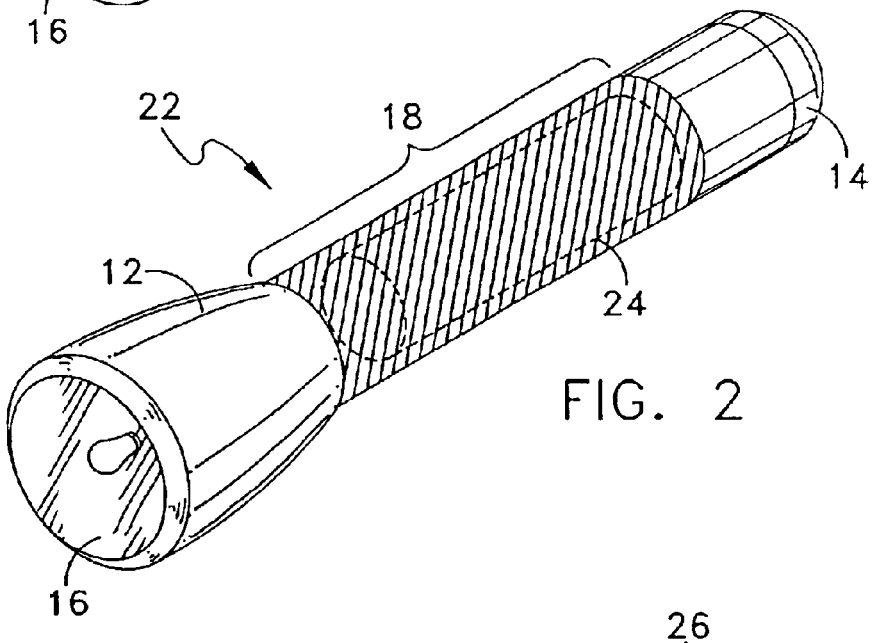
FIG. 2 is a perspective view of another embodiment of the security flashlight of the invention.

FIG. 2 shows a flashlight 22 wherein the entire handgrip area 18 employs a tension-biased, radially-activated switch 24, illustrated in dotted lines, where the flashlight 22 is activated by total one or two hand pressure anywhere in the handgrip 18 area.

Figure 3:
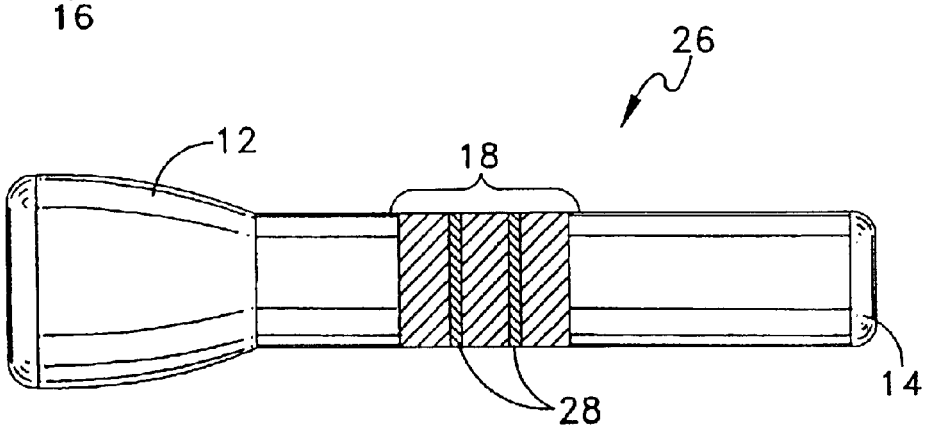
FIG. 3 is a plan view of a further embodiment of the invention.

FIG. 3 is a plan view of a security flashlight 26 with a handgrip 18 area, which employs two, spaced-apart, radial, pressure switch pads 28 of thin width, e.g., ¼ to ½ inch, encircling or substantially encircling the casing 12 in the handgrip area 18. This arrangement permits a user to employ either an overhand or underhand grip on the flashlight 26. The one or both switch pads 28 are operated or moved by the radial pressure between on-off, light activating positions, by the squeezing of the user's palm and fingers of the user's hand. Gripping pressure applied by merely the fingertips or thumb would not be sufficient to activate the switch pads 28.

The security flashlight of the invention avoids the difficulties experienced by a user in emergency situations over prior art security flashlights, where the on-off switch is located toward the light source and requires sufficient hand grip or squeeze pressure over and above the normal hand grip pressure used to hold and direct the flashlight, to activate the flashlight.

As discussed above, the security flashlight of the invention is used by security personnel such as police officers, security officers, military and firefighters, to illuminate an area of great distance, casting a directed beam from 1 to 21 feet (which is a critical zone) to up to 50 feet or more, even 100 feet in distance, in contrast to inexpensive novelty flashlights that illuminate only the area directly in front of the user, such as to illuminate keys, open door, or look in a pocketbook, and that are disposable and thus not made durable for years of service. Preferably, the flashlight of the invention illuminates a target from no less than 9 feet away, more preferably no less than from 12 feet or even 20, 50, or 100 feet distance. The minimum illumination distance required for a security flashlight will be known to those skilled in the art of equipment required by security personnel.

What is claimed is:

1. A security flashlight which comprises:

a) an elongated, cylindrical hard casing comprising a battery compartment, a first end, and a second end;

b) a removable end cap on said second end to insert and remove one or more batteries into or from said hard casing;

c) a light source at said first end of said hard casing; and d) a handgrip area peripherally arranged around a region of said hard casing the intermediate said first end and said second end, said region underlying said hand grip area, said handgrip area comprising means for electrically switching between an activation position and a deactivation position in response to a selected hand grip pressure, wherein said selected hand grip pressure exceeds a hand grip pressure that would be required merely to hold the flashlight and direct the light source, and wherein said switching means comprise one or more radial pressure-activated on-off switches.

2. The flashlight of claim 1, wherein said one or more switches comprises a generally central, peripheral band switch in the handgrip area.

3. The flashlight of claim 1, wherein said one or more radial pressure-activated on-off switches comprise a plurality of uniformly, spaced-apart elongated, pressure switch pads about the circumference of the handgrip area.

4. The flashlight of claim 3, wherein the plurality of switches are electrically connected, so that activation to any one switch connects the on position.

5. The flashlight of claim 1, wherein the selected hand grip pressure exceeds about 5 pounds per square inch.

6. The flashlight of claim 1, wherein said one or more radial pressure-activated on-off switches comprise metal, spring-biased, contact switches.

7. The flashlight of claim 1, wherein said one or more radial pressure-activated on-off switches comprise two metal, spring-biased, insulating, spaced-apart, contact switches, each one placed opposite the other side of the handgrip area, each switch arranged to move between the activation position and deactivation position on said selected hand grip pressure.

8. The flashlight of claim 1, wherein said handgrip area comprises a waterproof, polymeric material.

9. The flashlight of claim 1, wherein said one or more radial pressure-activated on-off switches comprises a peripheral, inner, metal band and a biased, peripheral, metal outer band, which are electrically insulated and spaced apart, and the outer band, on application of selected hand pressure, is arranged and constructed to contact the inner band.

10. The flashlight of claim 1, wherein said hard casing resists breakage when said flashlight is used to strike an object.

11. A method for the immediate illumination of an area with a security flashlight, which method comprises:

a) gripping the flashlight of claim 1 at the handgrip area; and b) activating said one or more radial pressure-activated on-off switches by applying said selected hand grip pressure.

* * * * *

UNITED STATES PATENT AND TRADEMARK OFFICE

CERTIFICATE OF CORRECTION

PATENT NO. : 6,814,465 B2
APPLICATION NO. : 10/246917
DATED : November 9, 2004
INVENTOR(S) : John D. Forsythe It is certified that error appears in the above-identified patent and that said Letters Patent is hereby corrected as shown below:

On the Title page item (12), under the entitlement of United States Patent, delete "Försythe" and insert --Forsythe--.

On the Title page item (76), Inventor: delete "Försythe" and insert --Forsythe--.

Signed and Sealed this

Sixteenth Day of October, 2007

JON W. DUDAS
*Director of the United States Patent and Trademark Office*